United States Patent [19]

Stampfli

[11] 3,949,985

[45] Apr. 13, 1976

[54] PLAYING IMPLEMENT

[76] Inventor: Louis Stampfli, Chemin des Cotes, CH-1297 Founex, Switzerland

[22] Filed: Nov. 22, 1974

[21] Appl. No.: 526,157

Related U.S. Application Data

[63] Continuation-in-part of Ser. No. 426,701, Dec. 20, 1973, abandoned.

[52] U.S. Cl. ..... 272/60 R

[51] Int. Cl.[2] ..... A63B 9/00

[58] Field of Search ..... 272/60 R, 66, 56.5 R, 1 B, 272/85; 297/458, 459

[56] References Cited

UNITED STATES PATENTS

| | | | |
|---|---|---|---|
| 2,559,846 | 7/1951 | Boucher | 249/101 |
| 3,360,152 | 12/1967 | Leers | 220/4 E |
| 3,381,844 | 5/1968 | Sieve | 46/24 |
| 3,561,757 | 2/1971 | Schillig | 272/60 R |
| 3,572,698 | 3/1971 | Greenly | 272/60 R |
| 3,632,109 | 1/1972 | Dattner | 272/60 R |
| 3,666,266 | 5/1972 | Noguchi | 272/60 R |
| 3,712,614 | 1/1973 | Sherman | 272/85 |
| 3,738,023 | 6/1973 | Sajkovic | 272/60 R |

*Primary Examiner*—Jerome Schnall
*Assistant Examiner*—Joseph R. Taylor
*Attorney, Agent, or Firm*—Bacon & Thomas

[57] ABSTRACT

A hollow body having means for connecting several bodies together, the hollow body consisting of two identical shell halves of synthetic material. The halves are provided with ribs and grooves and openings through which pass fixation elements. The hollow body further includes a boring which receives the connection elements, in order to connect several hollow bodies in a detachable manner. At least the top and bottom surfaces are concave, textured and have a plurality of holes whereby the playing surface is made less slippery when wet.

11 Claims, 6 Drawing Figures

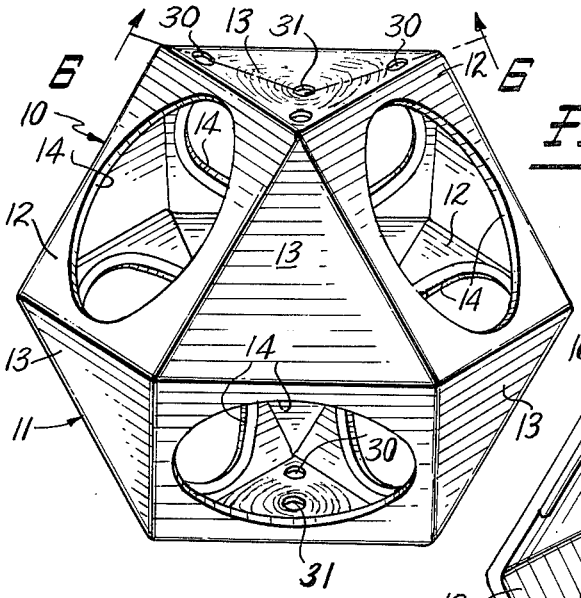
Fig. 1.
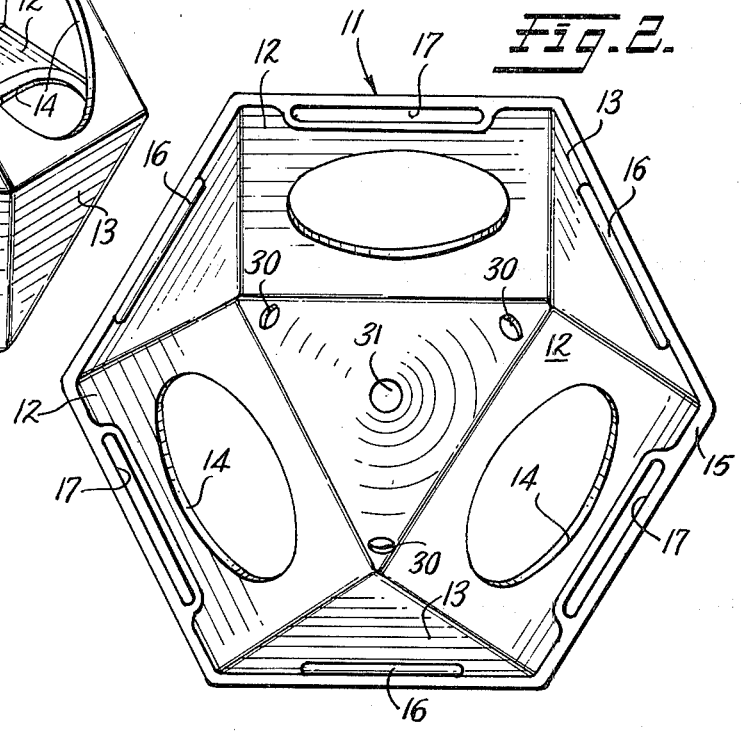
Fig. 2.
Fig. 6.
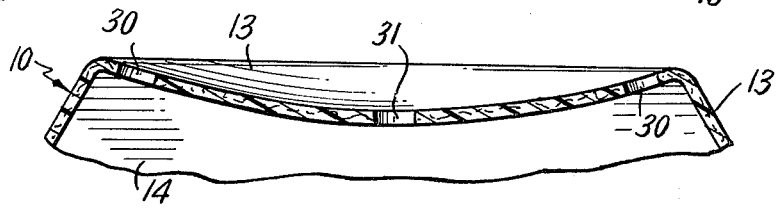
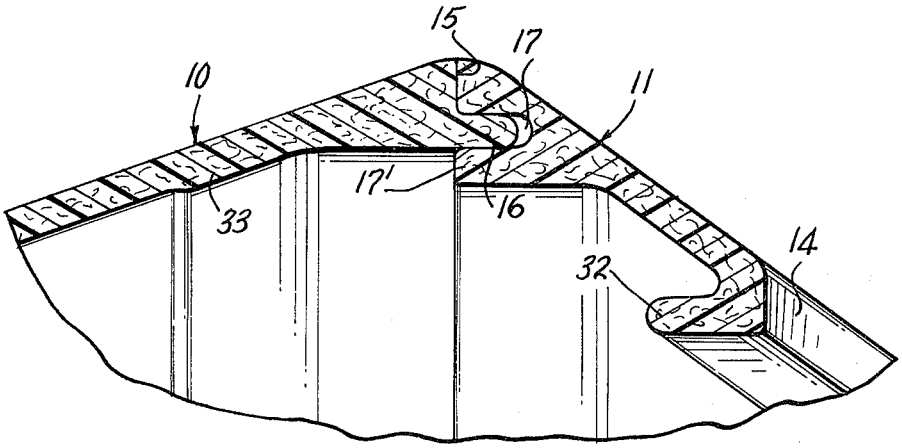
Fig. 3.

PLAYING IMPLEMENT

CROSS REFERENCE

This application is a Continuation-in-Part of application Ser. No. 426,701, filed Dec. 20, 1973, now abandoned.

BACKGROUND OF THE INVENTION

The present invention relates to a hollow body as part of a playing implement with means for connecting several bodies.

Bodies of the above-mentioned type are already known. In a well known proposal the hollow body has the form of a hollow octahedron with several openings. The hollow body consists of an element made of one part and it can be connected with other hollow bodies by means of additional rails.

Hollow bodies of this type have different disadvantages. First, the manufacture of a hollow body of this type is very costly, which means relatively high production costs. Secondly, the transportation of these hollow bodies in one piece causes a ceratin difficulty, these elements needing a space of about 1 $m^3$. When equipping a playground one needs a number of such elements. A third disadvantage of the prior art lies in the unsatisfactory fixation of the hollow bodies together by means of additional rail elements, thus making the construction difficult. Sometimes it is impossible to separate the joint elements in a short period of time by simple means, e.g. when changing the general configuration of a playground.

Another well known proposal relates to a hollow body of the above-mentioned type made of two parts. Means are provided therein for connecting those two parts together to form a unit. These means do not allow separation of the joint halves, and they may only be separated with great effort. Further alterations of the playground or the complete cleaning of the hollow bodies by separating them is impossible. A further important disadvantage of the prior art is the material of which they are made, i.e. hard foam. Since these elements are exposed to all types of weather and can be damaged by children, the choice of material is unpractical. Even a coating of paint is no remedy; the paint cracks, thus forming sharp edges which might injure children playing on them. Lastly, the prior art devices do not make a firm foundation for the connection of several hollow bodies together. An indication for the utilization of screwed elements for the said purpose can hardly be applied; a free fixation of such elements in a hard foam material can be scarcely guaranteed.

The prior art bodies have been slippery because of rain water remaining on the top surfaces and because the surface on which the children stand is flat.

SUMMARY OF THE INVENTION

The purpose of the present invention is to create a hollow body avoiding the disadvantages of the above-mentioned already known elements. The hollow body of the invention is easily transportable, and it includes means for connecting easily with other bodies in order to construct a playing implement of one's choice. Furthermore, it guarantees that children playing on a playground with playing implements made with the hollow bodies are not subjected to injuries.

The hollow body of the invention as part of a playing implement with means for connecting several hollow bodies together is formed by two identical shell halves of synthetic material, halves which are provided with ribs and screws in one side, with openings in the other side in order to be separated; the fixation elements pass through the openings. The hollow body comprises means of receiving connection elements in order to connect several hollow bodies together in a detachable manner.

Further, the top and bottom have concave, textured surfaces that include a plurality of openings for the removal of water, thus providing a device which is less prone to children slipping thereon.

BRIEF DESCRIPTION OF THE DRAWINGS

The preferential form of the invention is clearly illustrated by the following drawings wherein:

FIG. 1 is a perspective view of a hollow body made of two shell halves,

FIG. 2 is a plan view of the interior of one shell half of the hollow body, slightly enlarged, FIG. 3 is a sectional view through a part of the connection margins of both shell halves, slightly enlarged, FIG. 6 is an enlarged fragmentary vertical sectional view taken on the staggered line 6—6 of FIG. 1.

DETAILED DESCRIPTION OF THE DRAWINGS

Figure 4:
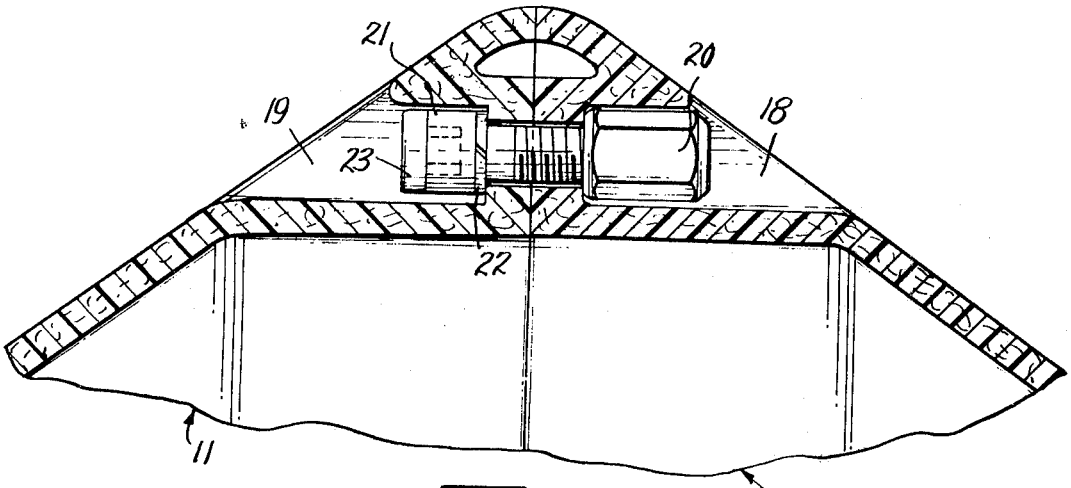
FIG. 4 is a sectional view through a part of the connection elements with their fixation elements of the shell halves, slightly enlarged.

FIG. 1 represents a hollow body of the invention formed of two detachable connected shell halves 10 and 11. The two shell halves are identical, each comprising three square surfaces 12 and four equilateral triangular surfaces 13. So, the hollow body formed of the cited shell halves consequently comprises six square surfaces 12 and eight triangular surfaces 13. Each square surface 12 has a circular opening 14 of a diameter to allow a little child effortless passage through the openings.

The hollow body forming an octahedron is preferentially made of "ULTRAMID", a glass fiber reinforced polyamide synthetic material. This synthetic material has an important advantage for the present purpose. It is indestructible, resistant to the weather and has a limited elasticity. The said synthetic material can be produced in different colors, thus avoiding later coloring or molding of the elements.

There is no cracking of paint, forming sharp edges, thus injuring children playing with the hollow bodies.

FIG. 2 shows a top view of the interior shell half 11 of the hollow body with three square surfaces 12 and four triangular surfaces 13. In order to center both shell halves 10 and 11 one above the other and to connect them, each shell half comprises on its interior side connection means 15 for the margin touching the other shell half. The said connection means are formed by ribs 16 provided on the three margins of the body and grooves 17, the margins being alternately provided with a groove and a rib. When connecting the two shell halves the precise fixation of the ribs is guaranteed by the elastic deformation of the wall 17' of the groove by press-fitting tongue 16 therein. This connection of the ribs and grooves is not sufficient to guarantee a strong fixation of the two shell halves. FIG. 4 shows two margin parts of the two shell halves 10 and 11. The corners of the shells are provided with cavities 18 and 19, respectively. The cavity 18 receives a nut 20, which can be connected to a flat headed screw 21. A washer 22 is placed between the head of the screw 21 and the rim of the cavity 19 which constitutes an entrance from above to a part of smaller cross-section of the cavity. A screw cap 23 is pressed onto the head of the screw to protect it from external influences, i.e., children tampering therewith.

The means of fixation or fastening represented and illustrated in FIG. 4 connect the two shell halves together. A detachable connection has been chosen so that the halves can be separated when desired. Together with the already illustrated means of centering and connection 16, 17, the means of fixation 18 to 22 form a sure and simply detachable connection for the shell halves. Neither the manufacture of the ribs 16 and the grooves 17, nor that of the fastening elements 18 to 22 causes a problem. The fastening elements 18 to 22 are of a known type of construction; they can be easily obtained on the market.

The cavities 18, 19 provided in the shell halves for receiving the connecting elements can be made when manufacturing the shell halves; they can also be made afterwards in a separate process. As FIG. 4 shows the cavities enable the connection elements to be completely embedded. Children are not injured by projecting parts.

Figure 5:
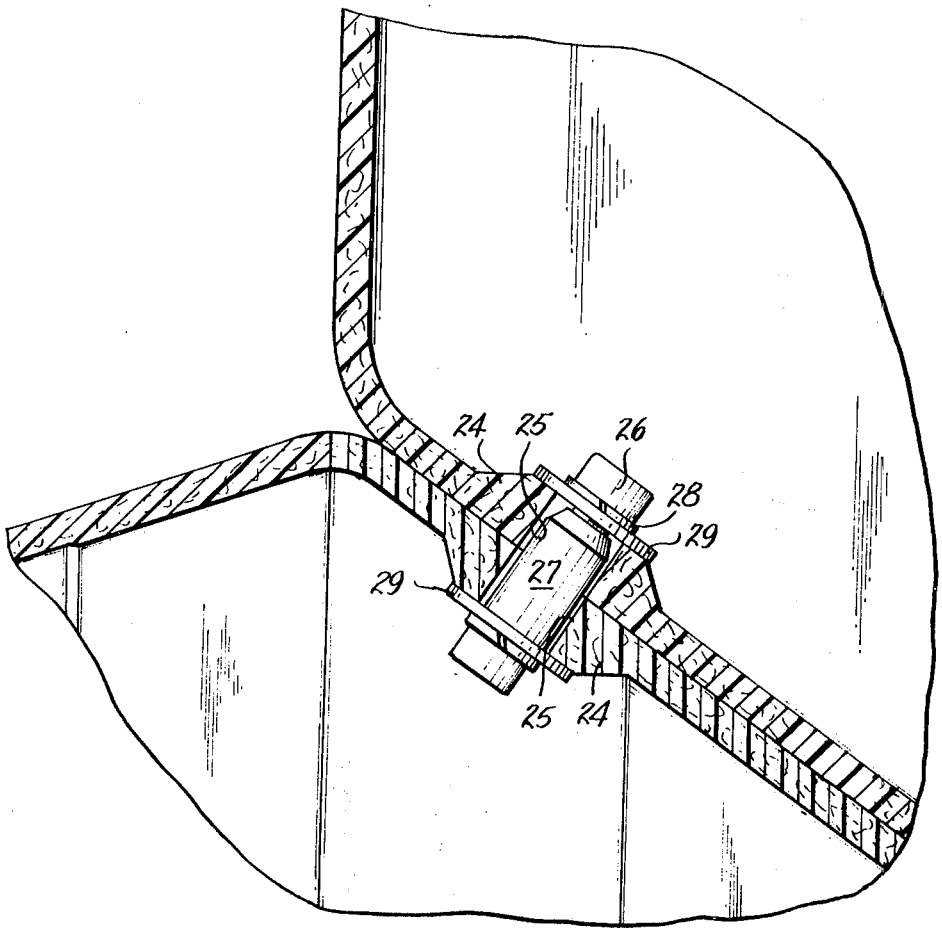
FIG. 5 shows the means of fixation for the connection of two hollow bodies slightly enlarged.

FIG. 5 shows the connection of two hollow bodies. The hollow body of the invention being used for the construction of playing implements, especially climbing structures in play-grounds. The structures are formed by putting together a certain number of such elements. For this purpose, the hollow elements are provided with reinforced parts 24 on the walls around borings 25 which are aligned when the hollow bodies are connected. A screw 26 is threaded into a stretchable plastic or stainless steel case 27, and a washer 28 and discs 29 complete the connection and fixation elements for the hollow bodies to be connected.

Even the connection elements used to connect the elements are detachable. This is necessary in order to build with the same hollow bodies different playing configurations, such as climbing structures, gymnastic structures and toboggans; it is an essential advantage to connect each element in a detachable way so that the stability of the playing implement does not suffer.

The corresponding assembly of hollow bodies allows the creation of different forms, by using a slide element made of the same material as the hollow bodies. A playing implement serving as toboggan can be obtained.

In order to avoid accidents on the surface, preferably a triangular surface of the hollow bodies comprises a structure preventing the children from slipping when they put a foot on this surface. This is extremely useful in wet weather when the dánger of slipping on the different surfaces of the hollow bodies increases. The hollow bodies thus prepared are connected so that the rough or coarse textured surface is horizontal and on top. The texturing characteristic is achieved by constructing the mold with a roughened interior on the sides desired to be textured.

It is also advantageous to form the top and bottom surfaces in a concave manner with four little openings 30 and 31 in order to guarantee the free outflow of rain. Openings 30 are near the corners of the triangles and permit water to drain from the bottom element, and center opening 31 permits water to drain from the top surface and facilitates fastening the unit to the ground. Obviously, more than just two opposite surfaces could be so formed, whereby the unit could be placed on any triangular surface.

A rib 32 seen in FIG. 3 is molded into the unit for reinforcing the opening 14, as is a reinforcing area 33 positioned at the corners.

Instead of the circular openings 14, through which playing children may climb into the interior of the hollow body and pass through the hollow body, one can foresee e.g. oval, square like or rectangular openings instead of circular ones. Therefore, the mold of the opening margin is very important, so that the children are not injured by the sharp edges. The opening margin shown in FIG. 3 corresponds to this requirement. The storage, transport and construction of several hollow bodies necessitate low requirements concerning space and training of the persons who accomplish the corresponding work.

While one embodiment of the invention has been described, it will be understood that it is capable of many further modifications and this application is intended to cover any variations, uses, or adaptations of the invention following in general, the principles of the invention and including such departures from the present disclosure as come within knowledge or customary practice in the art to which the invention pertains, and as may be applied to the essential features hereinbefore set forth and fall within the scope of the invention or the limits of the appended claims.

I claim:

1. A hollow body playground apparatus comprising:

a. a hollow body in the form of a polyhedron of a size to accommodate a child therein;

b. said hollow body being formed of a pair of symmetrical shell halves, each shell half including means for joining said halves together;

c. each shell half further having at least one face constructed of a size to permit a child to stand thereon;

d. said face on one shell being diametrically opposite said face on the other shell to provide top and bottom surfaces for the apparatus; said faces being concaved inwardly and having a plurality of holes therein, one of said holes being substantially in the center of said face, and the other of said holes being closer to the edge of said face whereby water will drain from the substantially center hole in the top face and from said other holes in the bottom face;

e. said two identical shell halves being made of plastic material, each having edges abutting like edges of the other shell half to form said hollow body;

f. a set of alternating tongues and grooves along said edges disposed so that tongues of one half shell snugly fit into facing grooves of the other half shell in removable assembled condition of said hollow body;

g. cavities across walls of said shell halves registering in pairs when said halves are assembled and fastening means in said cavities for fixing said halves together;

h. said body having at least one flat face for abutment against a like flat face of a like body to which it is to be connected and having connection means including an opening through said flat face and a connection element in said opening and in an aligned opening of said like body to removably join said bodies together.

2. A hollow body playground apparatus as in claim 1, with each shell half having three ribs and grooves, the connection means being provided at the circumferential margin of the hollow body so that during the connection of the halves every rib extends into a corresponding groove, to center and to partly fix the two halves.

3. A hollow body playground apparatus as in claim 1, the fastening elements comprising male and female screws.

4. A hollow body playground apparatus as defined in claim 1 wherein said each fastening element includes:

a. a nut received in one cavity of a pair, b. a screw received in the other cavity of said pair, c. said nut and screw joined together, d. the outer ends of said nut and screw being completely embedded in their respective cavities whereby no elements project therefrom.

5. A hollow body playground apparatus as defined in claim 4 wherein a screw cap is pressed onto the head of said screw to protect said screw from external influences.

6. A hollow body playground apparatus as defined in claim 1 wherein said at least one face is formed with a textured surface molded thereon.

7. A hollow body playground apparatus as defined in claim 1 wherein said plastic material is itself colored throughout.

8. A playground apparatus as defined in claim 1 wherein said faces are triangular and have one hole in about the center thereof and a hole adjacent each corner.

9. A playground apparatus as defined in claim 1 including four equilateral triangular faces and three square faces on each shell half.

10. A playground apparatus as defined in claim 9 wherein at least some of said square faces have openings therein, said openings being large enough to permit a child to easily pass through.

11. A playground apparatus as defined in claim 1 wherein said connection means includes a plurality of borings in said flat face to be joined together, a case being inserted in one boring, a screw inserted in the other boring and into said stretchable case to join the bodies together.

* * * * *